US005643104A

United States Patent [19]

Antonious

[11] Patent Number: 5,643,104

[45] Date of Patent: Jul. 1, 1997

[54] METAL WOOD TYPE GOLF CLUB HEAD WITH IMPROVED HOSEL CONSTRUCTION

[76] Inventor: Anthony J. Antonious, 7738 Calle Facil, Sarasota, Fla. 34238

[21] Appl. No.: 362,897

[22] Filed: Dec. 23, 1994

[51] Int. Cl.[6] ..... A63B 53/04

[52] U.S. Cl. ..... 473/305; 473/324; 473/314; 473/307

[58] Field of Search ..... 473/305, 315, 473/306, 345, 330, 327, 324, 314, 307, 308, 309, 310, 311, 312

[56] References Cited

U.S. PATENT DOCUMENTS 4,986,541 1/1991 Teramoto et al. ..... 273/77 A 5,028,049 7/1991 McKeighen ..... 273/167 H 5,163,682 11/1992 Schmidt et al. ..... 273/167 J 5,377,986 1/1995 Viollaz et al. ..... 273/173

*Primary Examiner*—Vincent Millin

*Assistant Examiner*—Charles W. Anderson

*Attorney, Agent, or Firm*—Finnegan, Henderson, Farabow, Garrett & Dunner, L.L.P.

[57] ABSTRACT

A metal wood type golf club head wherein at least a portion of the hosel is connected to and spaced outwardly from the body shell of the club head preferably forming a dual radius configuration with a first radius formed by the heel area of the club head and a second smaller radius and formed by the hosel located on and protruding outwardly from the first radius.

34 Claims, 10 Drawing Sheets

10
12
13
14
15
16
18
22
24
26
CP
H
L

METAL WOOD TYPE GOLF CLUB HEAD WITH IMPROVED HOSEL CONSTRUCTION

BACKGROUND AND SUMMARY OF THE INVENTION

The present invention relates to metal wood type golf club heads and, in particular, to a metal wood club head having an improved hosel construction.

Conventional metal wood type club heads include a hosel structure which is integrally formed and which transitions into the club head body whereby the outer surfaces of the hosel assembly smoothly transitions into the outer surfaces of the club head body particularly in the heel area of the club head.

Generally, the base of traditional hosels for metal wood type clubs are formed on the crown portion or upper surface of the club head adjacent the heel area. For some types of metal woods, the hosel extends through the upper surface of the crown and into the shell cavity below. In this type of hosel-socket construction the end of the shaft is located at the crown surface or just below it extending a little into the shell cavity. Since the shaft is the main source of power, the energy transfer takes place primarily at the upper portion of the club head where it is substantially away from the CG or center of percussion. Full golf swings produce considerable club head twisting and torquing, especially at the base of traditionally formed hosels. This has always been the cause of consistent problems such as broken shafts and bent or loose shafts.

The present invention relates to a golf club head structure wherein at least a significant portion of the hosel is spaced from and specifically located outside the outer surface of the shell section of the club head body adjacent the club's heel area.

The unique structural design of the present invention eliminates or greatly minimizes prior art problems. This is accomplished by having a substantial portion of the hosel and shaft socket formed beyond the outer club head wall at the heel area. Preferably, the outer wall of the shell, at the critical heel area, and the outer type hosel and socket are joined along most, if not all of the height of the outer wall, thereby creating a much stronger structural bond at this critical area. The juncture extends along at least one half of the height of the outer wall, more preferably along three quarters of the outer wall. The circumferential wall of the hosel that forms a socket for a club shaft extends downward beyond the crown of the club head shell and into the shell cavity. This unusual hosel construction minimizes the amount of uncontrolled and undesirable club head distortions and adverse rotational deviations that occur when a conventional club head is swung and strikes a golf ball. The longer and wider surface connections between the thin walls of the club head shell and the thicker walls of the hosel, absorb much more of the metal stress, and are less affected or damaged by the "shock-impact" that occurs to club heads when hitting golf balls. Applying additional controlled leverage is more easily achieved and with less effort in executing shots that require "drawing" or "fading" the ball when desired.

Importantly, the construction of and location of the outside hosel and shaft socket of this invention permits a greater transfer of energy closer to the CG or center of percussion. This improvement delivers more "solid" ball contact repeatedly producing more accurate hits and longer distances. Further, this hosel construction produces less vibration and greater cushioning in absorbing the shock to hands upon initial ball contact and/or ground contact, particularly when off-center hits occur.

In some embodiments, the shaft socket of the hosel extends to a point adjacent the bottom surface plate or bottom of the club head. For some preferred embodiments, the shaft may extend through the shaft-socket to create a "bore through" type hosel. However, for all such models, at least a substantial part of the "bore through" occurs outside the shell cavity unlike other so called bore-through metal wood club heads wherein their shafts pass through the shell cavity and extend through the bottom surface plate of the club head.

In some preferred embodiments, the club head includes a peripheral mass immediately behind and around all or part of the outer perimeter of the club head face. This peripheral mass serves as a reinforcement member which extends around the entire periphery of the frontal body section where the outer walls of the frontal body section interface.

In other embodiments, the front surface of the outer hosel serves as a continuation of the club head face, while the rear surface of the outer hosel transitions into the heel wall of the main body or shell of the club head. This wrap around embodiment provides a larger hitting surface along with increased strength and stability, when compared to conventional designs.

Among the objects of the present invention are the provisions of a metal wood-type golf club head providing greater control and square-clubface stability at impact, and which substantially enhances club head resistance to twisting and torquing, as well as other adverse effects from club head knock-back that occurs especially when hitting golf balls from thick or heavy grass conditions or when off-center ball contact occurs.

Another object is the provision of a metal wood type golf club head having a unique hosel construction with at least a portion of its outer surface partially spaced from the main body of the club head to create increased club head speed and stability and more leverage by maximizing energy transfer from the shaft to the club head when a golf ball is struck to achieve optimum distances. These and other objects will become apparent with reference to the accompanying drawings and specification.

DESCRIPTION OF THE PREFERRED EMBODIMENTS

Figures 1, 2, 3:
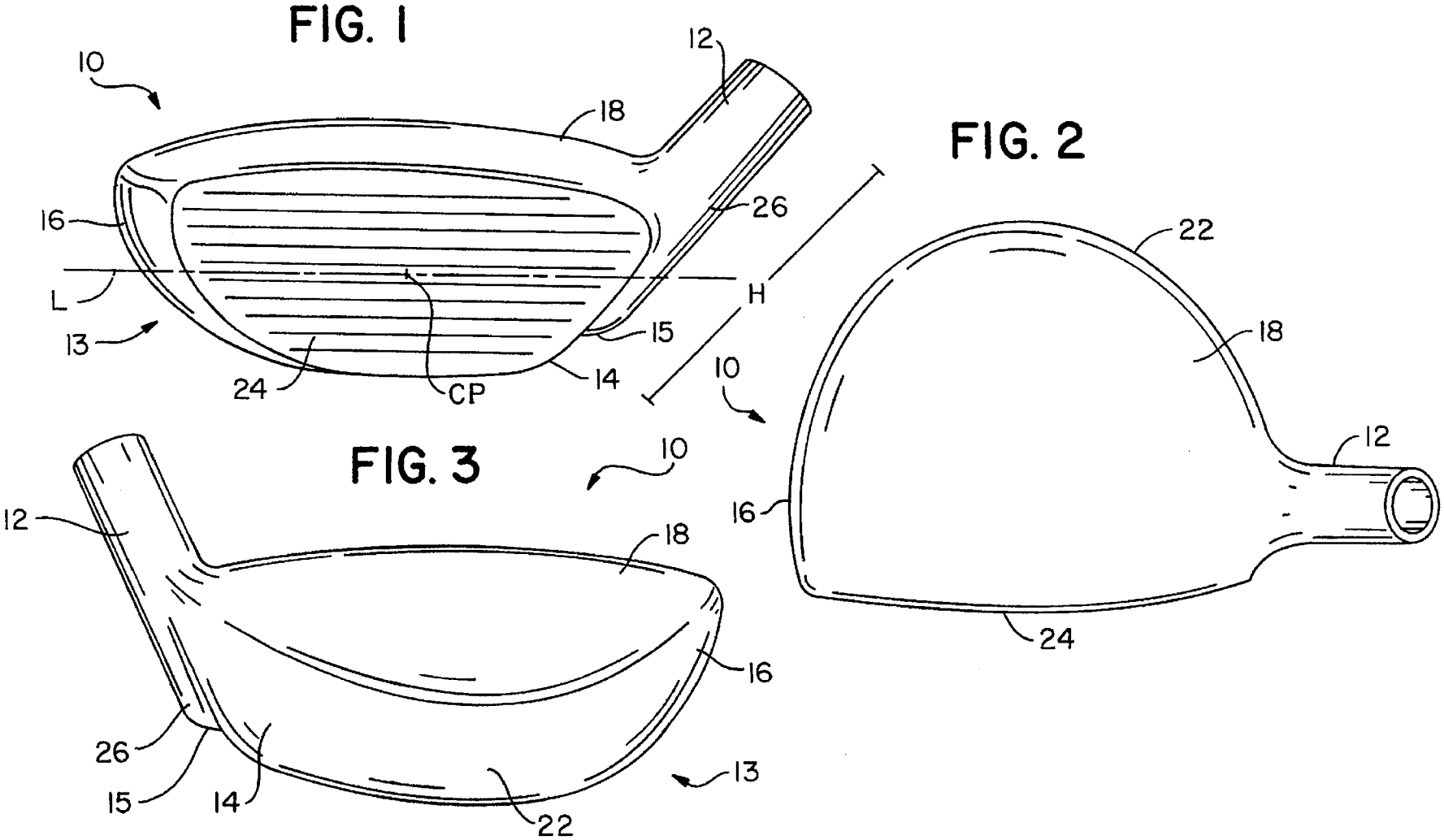
FIG. 1 is a front elevational view of a metal wood type golf club head in accordance with the present invention.
FIG. 2 is a top plan view of the club head of FIG. 1.
FIG. 3 is a rear view of the club head of FIG. 1.
Figure 5:
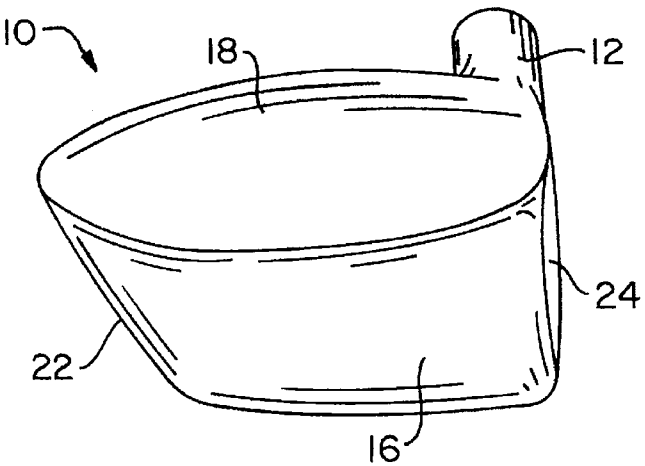
FIG. 5 is an end view of the club head of FIG. 1.
Figure 6:
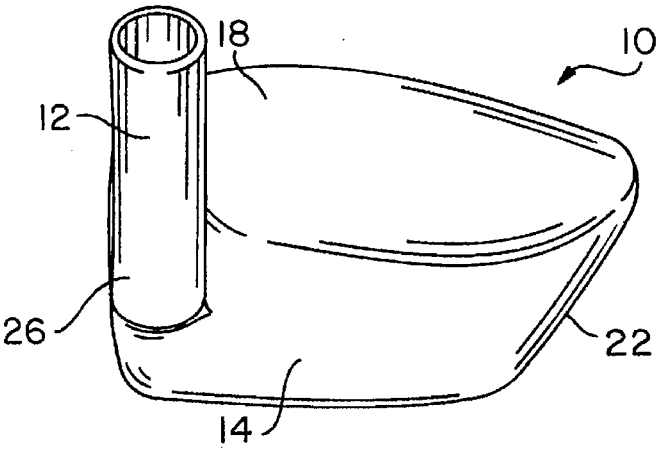
FIG. 6 is an end view of the club head of FIG. 1 from the opposite end of FIG. 5.

FIGS. 1 to 7 illustrate a first embodiment of a golf club head 10 in accordance with the present invention. The golf club head includes a main shell body 13 including a heel 14, toe 16, upper surface or crown 18, bottom surface 20, rear surface 22 and ball striking face 24. The club head 10 also includes a hosel 12 which in each embodiment extends, at least in part, outwardly, in a toe to heel direction, beyond the main shell body 13 at the heel area of the club. As can be seen particularly with reference to FIGS. 1, 3 and 4, the hosel 12 includes an outer portion or extension 26 formed outside of the outer surface of the main shell body 13 of the club head 10.

In this embodiment illustrated in FIGS. 1–7, it is preferable that at least one-third of the overall diameter of the hosel 12 extends beyond the main shell body 13 of the club head 10 forming a bulge or protrusion on the heel 14 of the club head 10. In this embodiment, the portion of the hosel that extends beyond the main shell body 13 more preferably extends at least one-half the outer diameter of the hosel 12 and most preferably extends approximately two-thirds of that distance. As explained in more detail below, the extension of the hosel beyond the outer surface of the hell portion of the main shell body 13 provides increased leverage and power.

As shown in the drawings, the hosel 12 connects with heel 14 of the main shell body 13 of the club head along at least one-half of its height H (See FIG. 1) at the heel and more preferably along at least two-thirds of that height. As a result, a bottom edge 15 of the hosel 12 extends at least to, and preferably beyond, a line "L" drawn through the center of percussion of the club head and parallel to the bottom surface of the club head, providing an extremely strong and stable connection. Similarly, the hosel 12 preferably is designed to include a shaft socket that will accept a shaft extending along the entire length of the hosel, so that the shaft will extend at least to, and preferably beyond, the club head's center of percussion.

Figure 7A:
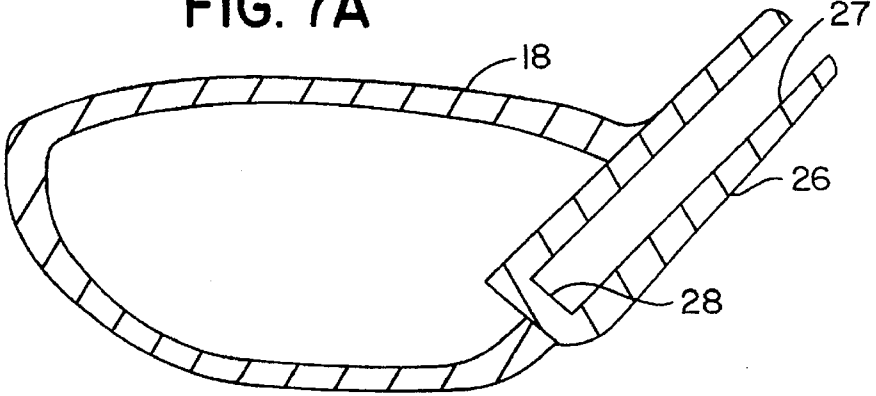
FIG. 7A is a cross-sectional view of the club head of FIG. 1.
Figure 8:
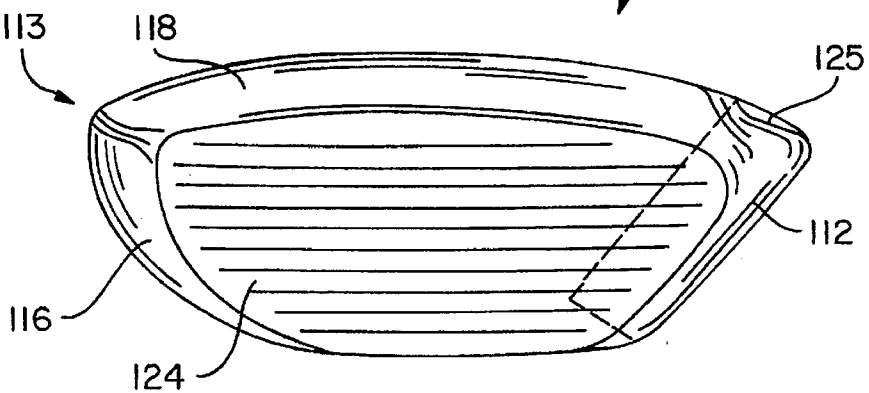
FIG. 8 is a front elevational view of a second embodiment of the present invention.
Figure 7:
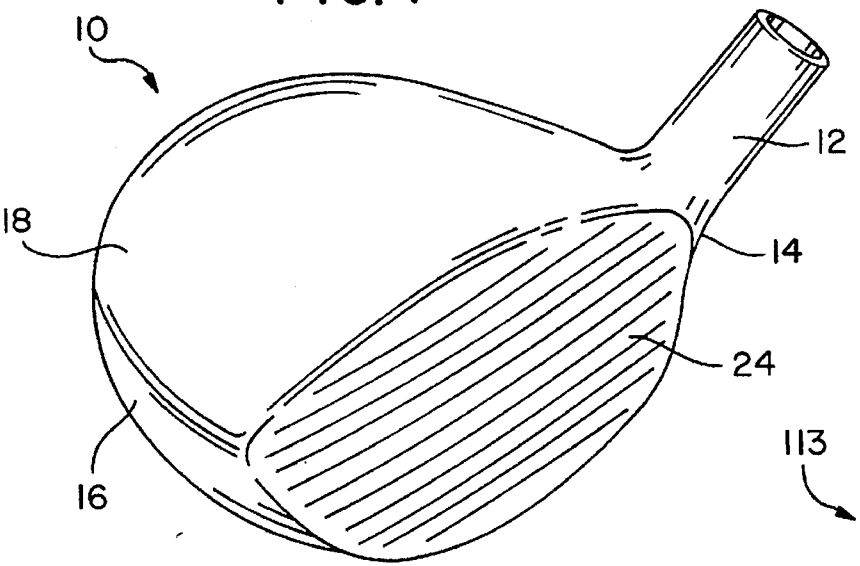
FIG. 7 is a top perspective view of the club head of FIG. 1.
Figure 11:
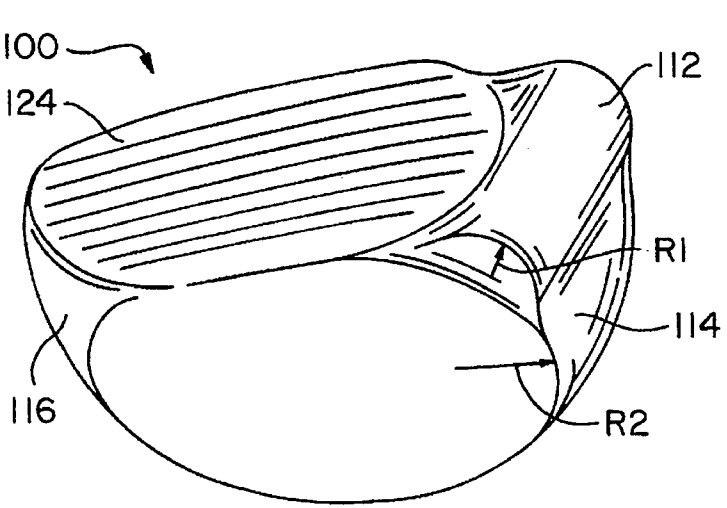
FIG. 11 is a bottom perspective view of the club head of FIG. 8.
Figure 12:
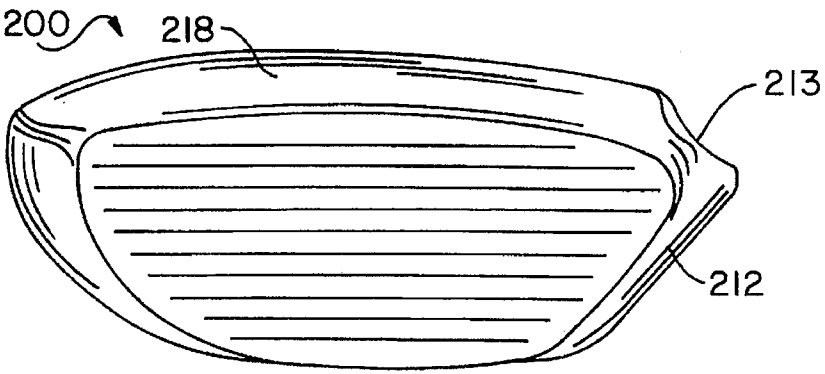
FIG. 12 is a front elevational view of a third embodiment of the present invention.
Figure 9:
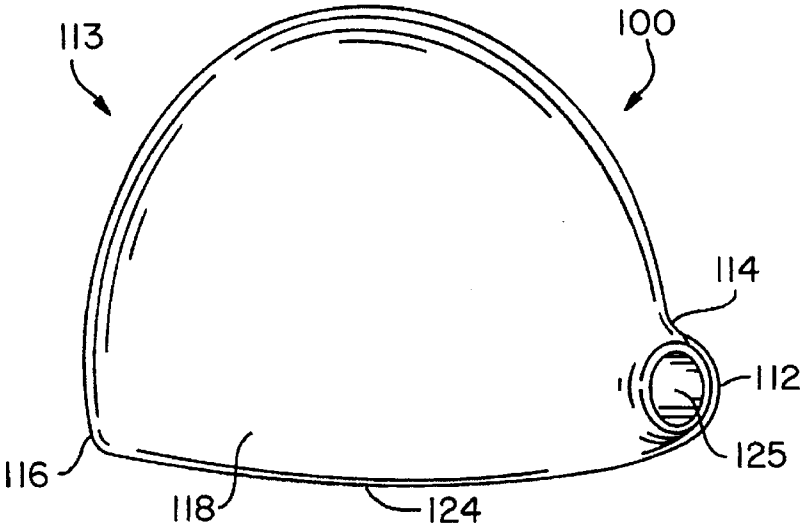
FIG. 9 is a top plan view of the club head of FIG. 8.
Figure 10:
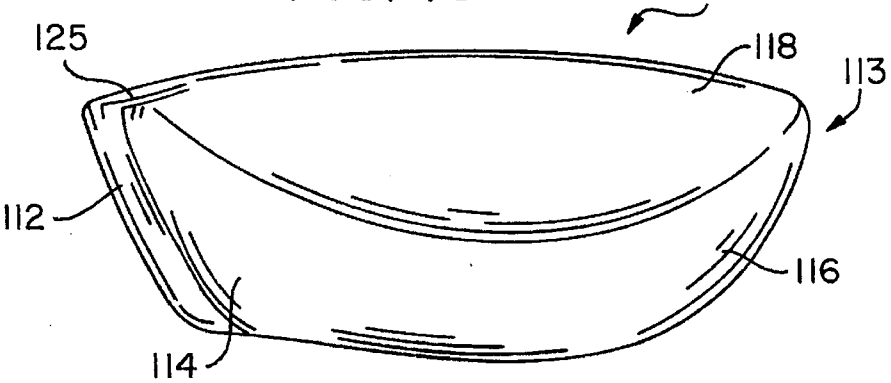
FIG. 10 is a rear elevational view of the metal wood club head of FIG. 8.
Figure 14:
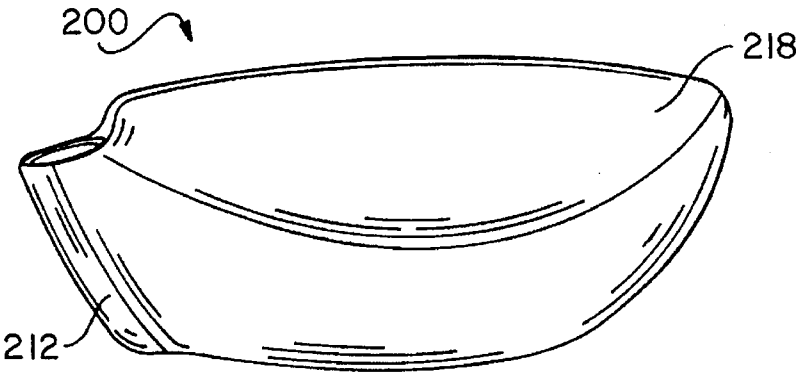
FIG. 14 is a rear view of the club head of FIG. 12.
Figure 15:
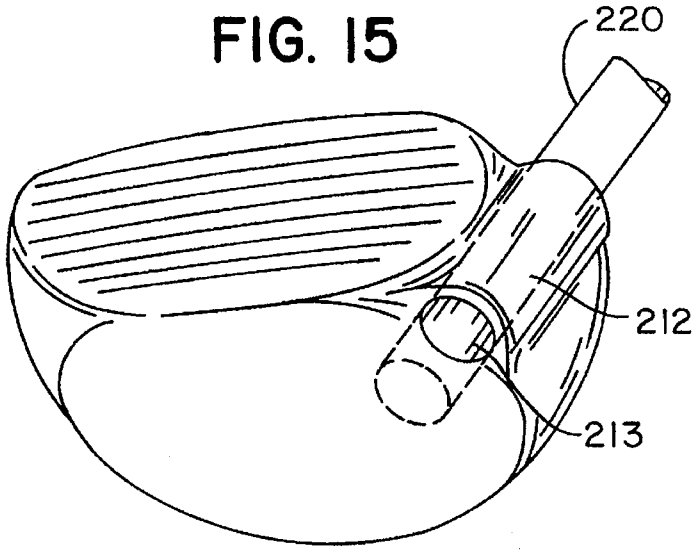
FIG. 15 is a bottom perspective view of the club head of FIG. 12.
Figure 13:
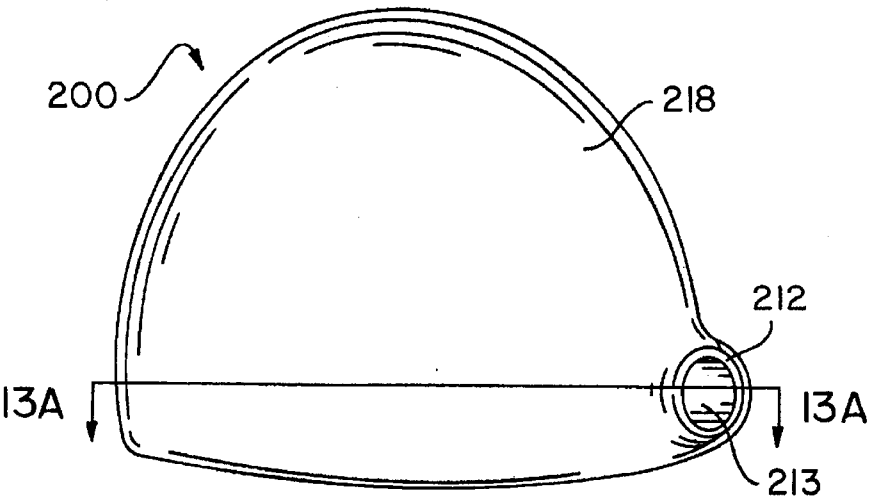
FIG. 13 is a top plan view of the club head of FIG. 12.
Figure 13A:
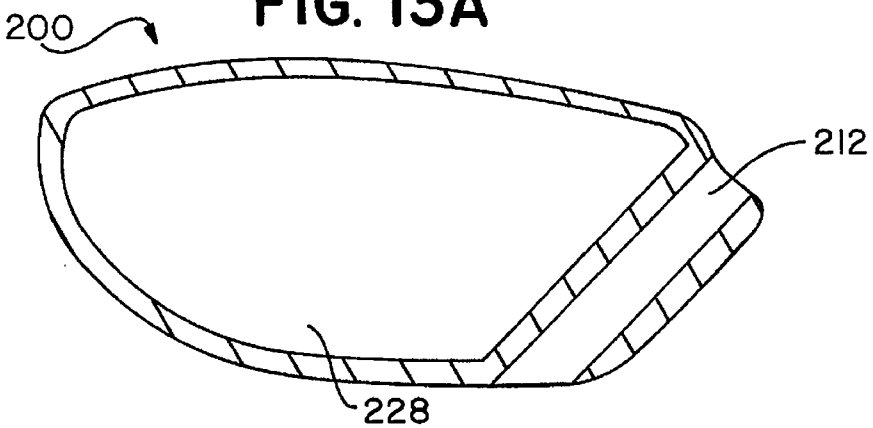
FIG. 13A is cross-sectional view of FIG. 12.
Figure 18:
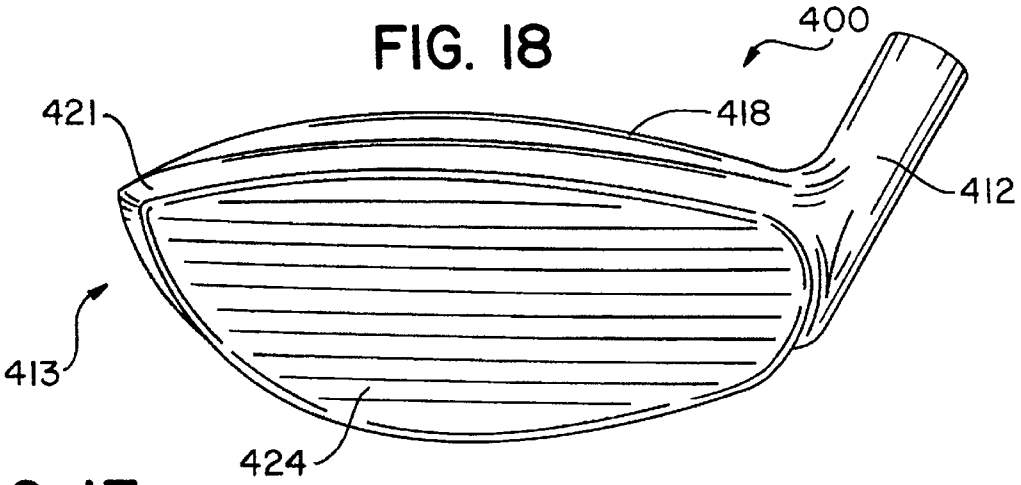
FIG. 18 is a front elevational view of a fifth embodiment of a golf club head in accordance with the present invention.

As shown in FIG. 7A, the hosel 12 preferably has a cylindrical wall 27 forming a shaft socket, that extends along the entire length of the hosel 12. The hosel 12 also preferably includes a bottom surface 28 against which the bottom of the shaft can rest. As shown in the illustrated embodiments, a significant portion of the cylindrical wall 27 is completely outside of the heel 14 of the shell while the remaining portion of the cylindrical wall extends into the internal club head cavity formed by the main shell body 13 of the club head. This design provides optimum support for the shaft and a strong and stable connection between the main shell body 13 and the club head shaft. The invention, however also contemplates embodiments where the cylindrical wall of the hosel does not extend into the shell cavity or extends only partially into the shell cavity. For example, the club head could be designed to include flanges or partial walls within the shell cavity, rather than a completely cylindrical wall, to hold and restrain the shaft.

The front surface of the hosel 12 of the club head is set back slightly from the striking face of the club head, as best shown in FIG. 2. This design provides a clean break between the face of the main shell body 13 and the hosel 12 and permits optimum weights and force distribution for a given club. In the embodiment illustrated in FIG. 1, the hosel is set back approximately 1/16 to 1/8 of an inch. As shown in the other embodiments, the degree of offset depends upon the overall configuration and design of the club.

As shown, the bottom of the illustrated hosel 12 is spaced above the bottom surface of the club head to avoid increased friction between the club head and ground as the ball is hit. In the illustrated embodiment, the bottom of the hosel 12 is spaced between 1/8 and 3/8 of a inch from the bottom surface, the hosel 12 has a total length of approximately 1¼ to 1½ inches, and the hosel 12 connects with the heel 14 of the main shell body 13 along at least ½ of an inch, preferably at least ¾ of a inch.

Figure 4:
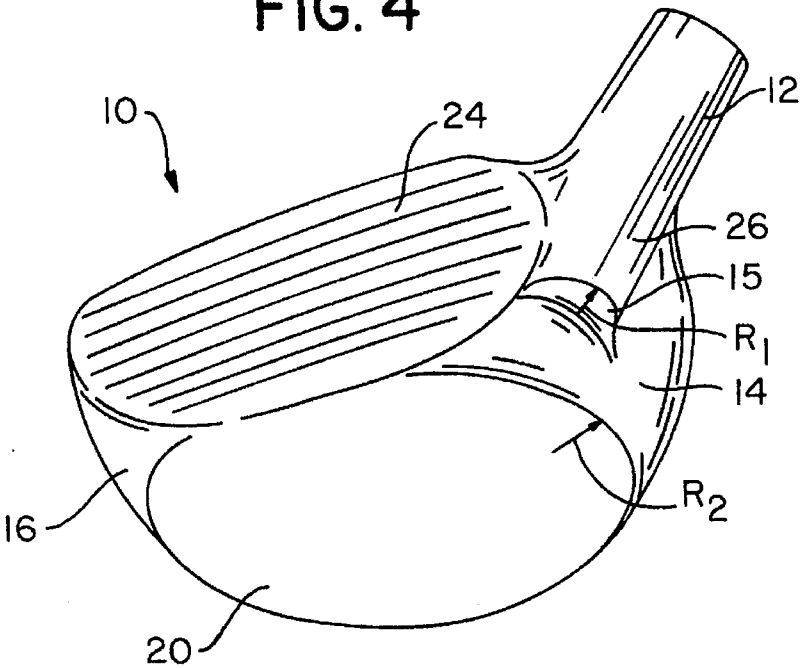
FIG. 4 is a bottom perspective view of the club head of FIG. 1.

As can be seen, particularly with respect to FIG. 4, the hosel 12 is formed with a first radius R1 whereas the heel 14 is formed with a second, much larger, radius R2 relative to the radius R1 of the hosel 12. This dual radius structure at the heel 14 is unique in the metal wood golf club art.

With the club head 10 of the present invention, the location of the hosel 12 provides more controlled leverage and improved stability, a more solid feel when ball contact is made, and results in greater accuracy and distance for the same swing effort applied with conventional metal woods.

FIGS. 8, 9, 10 and 11 show a second embodiment of a golf club head 100 in accordance with the present invention which club head includes a heel 114, toe 116, top surface 118 and ball striking face 124. The club head 100 is hoselless above the top surface 118 of the club head. In this embodiment, a shaft socket 125 and hosel 112 is formed approximately level with the top surface 118 of the club head 100. As can be seen, particularly with respect to FIGS. 10 and 11, hosel 112 has a smaller radius R1 which extends beyond and outwardly from a larger radius R2 of the heel 114, forming a dual radius configuration similar to the club head described hereinabove.

FIGS. 12, 13, 13A, 14 and 15 show a third embodiment of the golf club head 200 of the present invention including a hosel 212 and a shaft-receiving socket having a shaft-receiving opening 213 located below the upper surface 218 of the club head. With this structure, a substantial portion of the hosel 212 is formed outside the shell cavity 228 and is open throughout its entire length whereby a shaft 220 may extend totally through the hosel 212 for added structural integrity. With the exception that this hosel 212 does not extend above the crown 218 and has openings at both the top and bottom to accept the club head shaft 220, the size, shaft, and characteristics of the hosel 212 are like those described with respect to the hosel in the first two embodiments.

Figure 17:
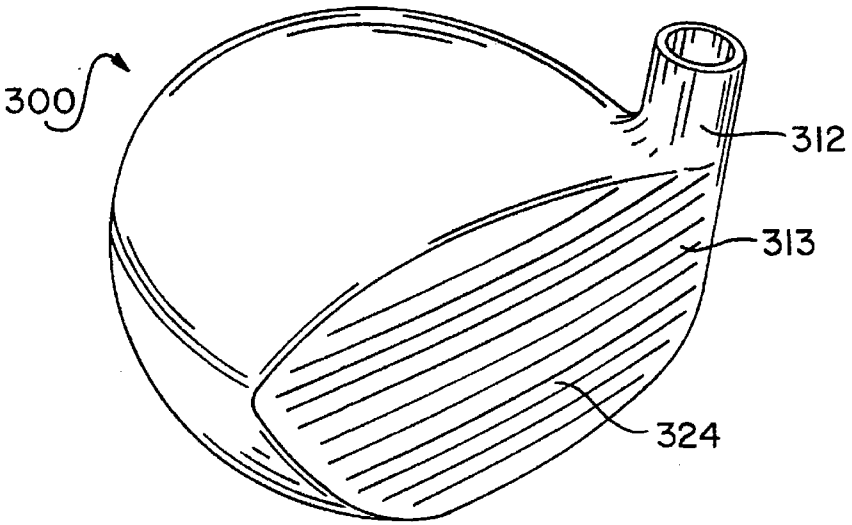
FIG. 17 is a top perspective view of the club head of FIG. 16.
Figure 16:
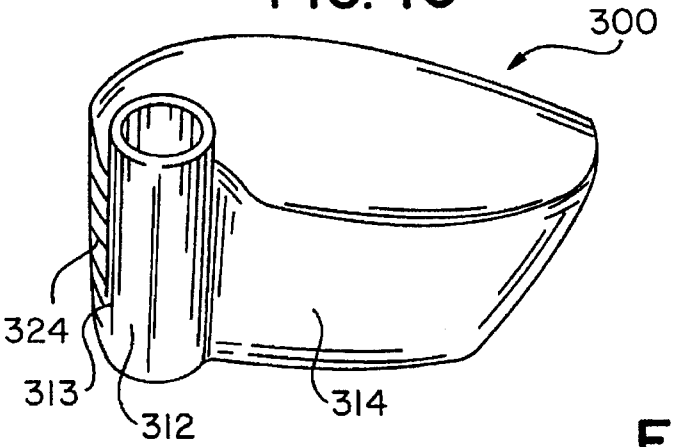
FIG. 16 is an end elevational view of a fourth embodiment of the present invention.
Figure 20:
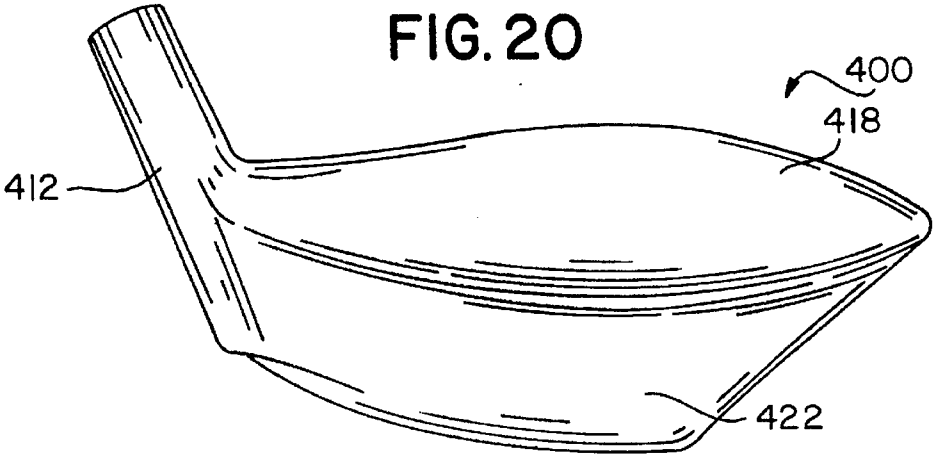
FIG. 20 is a rear elevational view of the golf club head of FIG. 18.
Figure 21:
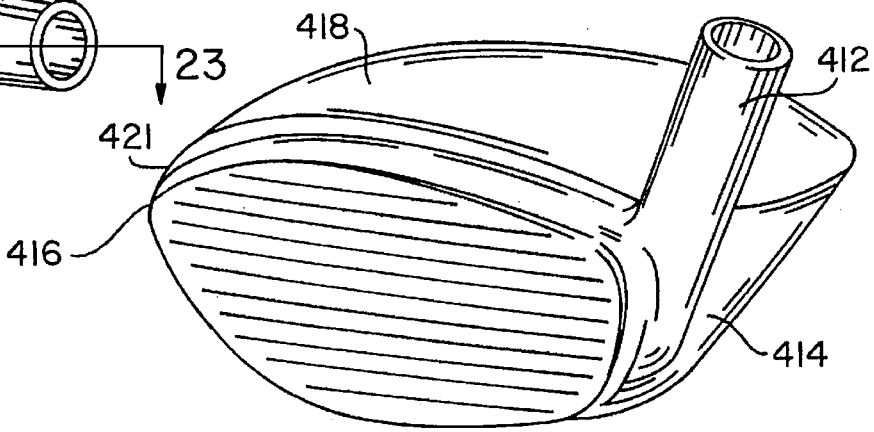
FIG. 21 is a front perspective view of the club head of FIG. 18.
Figure 19:
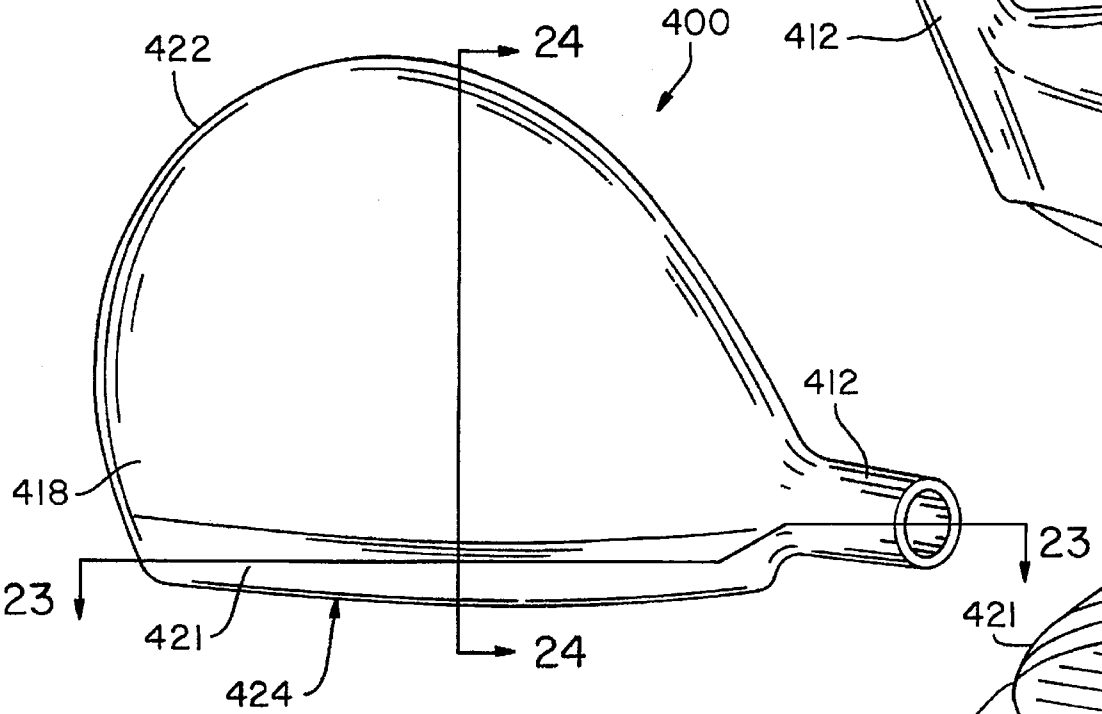
FIG. 19 is a top plan view of the club head of FIG. 18.

FIGS. 16 and 17 show a fourth embodiment of a golf club head 300 in accordance with the present invention including an outside hosel 312 and a ball striking face 324 which extends all the way to the front outer edge 313 of the hosel 312, in a toe to heel direction, rather than terminating at the edge of the heel 314. In this embodiment, the majority of the hosel 312 extends outward (in a toe to heel direction) of the heel surface 314 of the club head shell. The hosel 312, like that used in the first embodiment, preferably has a cylindrical wall from top to bottom to provide an elongated, cylindrical socket for a shaft. The ball striking face 324 of the club head extends across the front of the hosel 312, providing a wrap around effect. As a result, for a given shell size, this embodiment provides a larger ball striking face 324, particularly at the heel 314 of the club head 300.

FIGS. 18 through 24 show still another embodiment of a golf club head 400 in accordance with the present invention. The club head 400 has a main shell body 413 having a heel 414, toe 416, upper surface or crown 418, rear surface 422, shell cavity 428 and a ball striking face 424. The hosel 412 in this embodiment is like that disclosed in the first embodiment. In this embodiment, the club head 400 is shaped having an aerodynamic configuration with the bottom surface 420 being substantially smaller than the upper surface 418. The ledge 421 is substantially perpendicular to the striking face of the club head and preferably has a width (from front to rear) within the range of ⅛ to approximately ½ of an inch. At the interface of the ledge 421 and the main portion of the upper surface 418 of the club head, the upper surface 418 extends upwardly to provide a conventional, arcuate crown. The air flow is considerably altered by set back ledge 421 as it encounters the improved configuration at the frontal portion of the upper surface 418. The improvement, the set back ledge 421, dramatically increases the overall aerodynamic results by more quickly developing a laminar air flow. As with the previous embodiments described hereinabove, the hosel 412 extends beyond the outer surface of the heel 414 forming a "two-radius" configuration.

Figure 23:
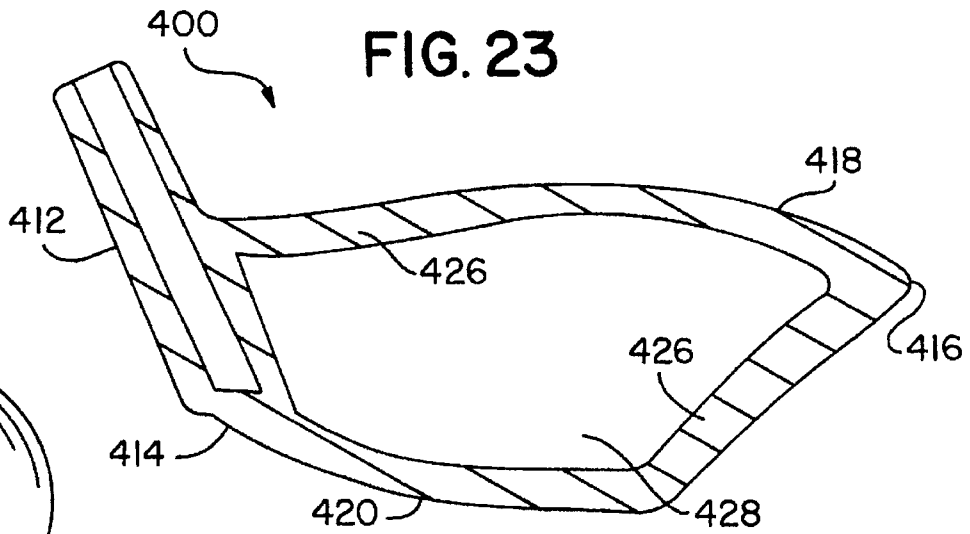
FIG. 23 is a sectional view taken along the line 23—23 of FIG. 19.
Figure 24:
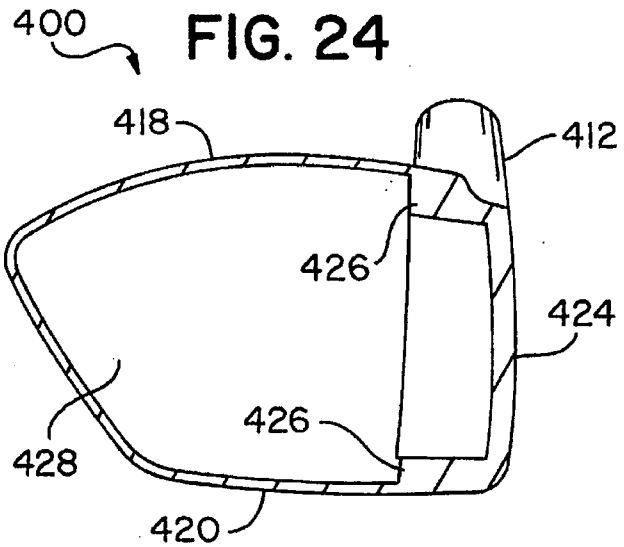
FIG. 24 is a sectional view taken along the line 24—24 of FIG. 19.
Figure 22:
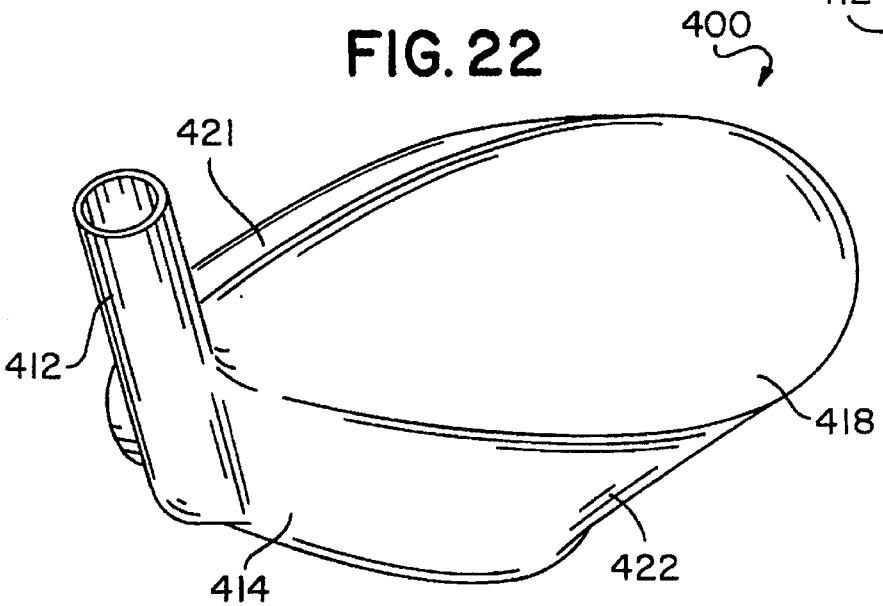
FIG. 22 is a rear perspective view of the club head of FIG. 18.

Referring to FIGS. 23 and 24, which are sectional views, the club head is provided with an inner peripheral weight member 426 which preferably extends around the inner rear peripheral edge of the ball striking face 424. The advantages of this peripheral weight 426 outlined in detail in co-pending application Ser. No. 08/280,177, filed Jul. 25, 1994, which application is hereby incorporated herein by reference. Referring to FIG. 23, it can be seen that the hosel 412 is formed laterally of the peripheral weight 426 and integrally attached thereto to add to the structural integrity of the club head 400.

Figure 26:
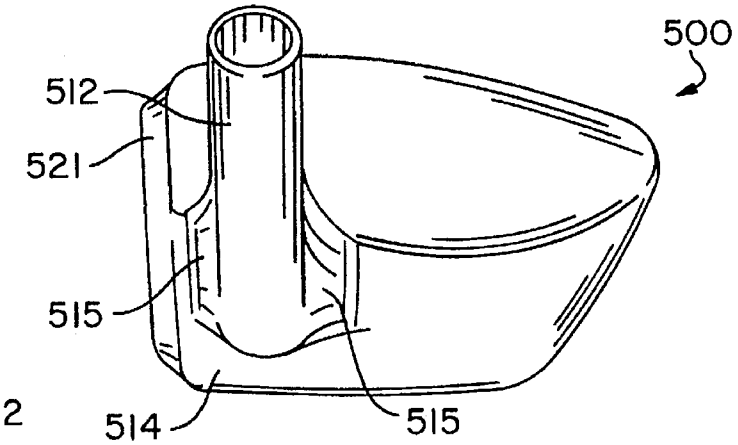
FIG. 26 is an end view of the club head of FIG. 25.
Figure 26A:
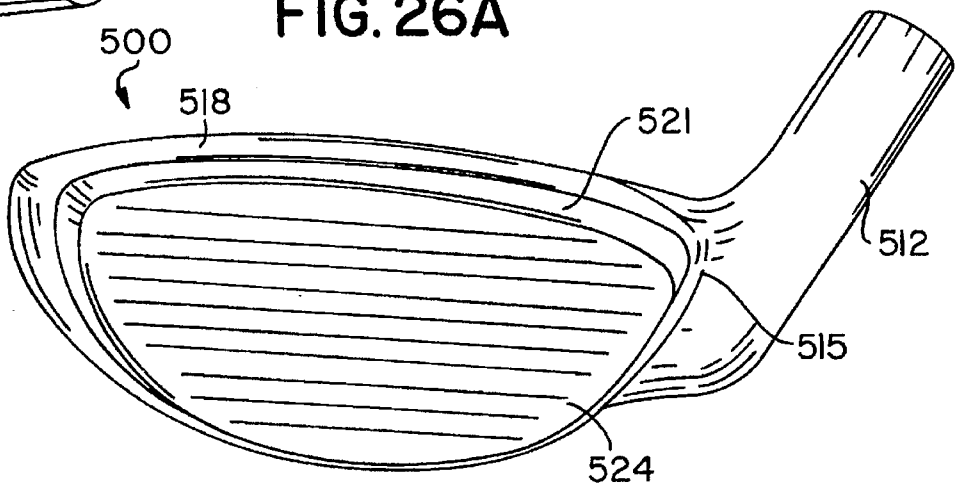
FIG. 26A is a front view of the club head of FIG. 25.
Figure 25:
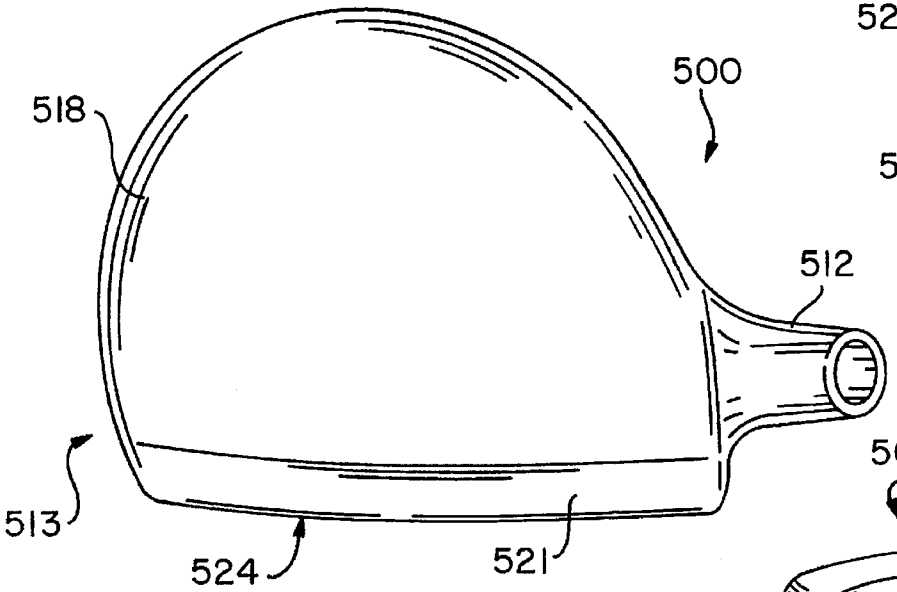
FIG. 25 is a top plan view of a sixth embodiment of the present invention.

A sixth embodiment of the present invention is illustrated in FIGS. 25, 26 and 26A. In this embodiment, substantially all, or all, of the hosel 512 extends outward of the heel 514 of the main shell body 513 of the club head 500. In the preferred embodiment, the entire shaft socket of the hosel 512 is outward the main shell body 513, and the hosel 512 includes flared sides 515 that extend beyond the outer diameter of the elongated cylinder of the hosel 512 and provide a smooth transition and strong connection between the hosel 512 and the shell 513. In addition, in this embodiment the hosel 512 is set back from the striking face 524 of the club head. This embodiment, like that the firth embodiment, includes a ledge 521 along at least the upper surface 518 of the club and a perimeter weight that preferably extends around the entire outer perimeter of the club face, immediately behind the club's striking face 524.

Figure 27:
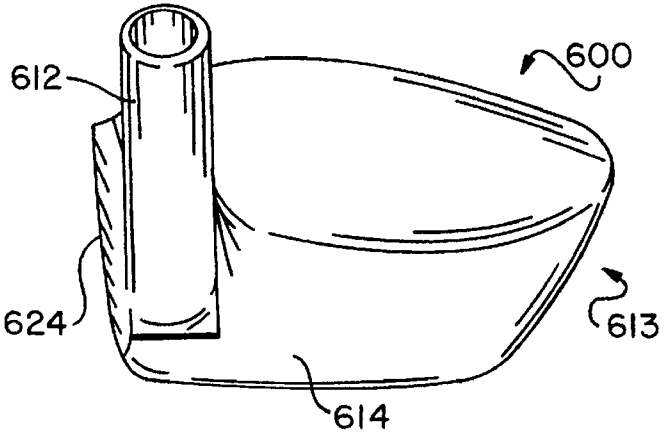
FIG. 27 is an end view of a seventh embodiment of the present invention.

A seventh embodiment of the present invention is shown in FIG. 27. This embodiment is substantially similar to the fifth embodiment except for two changes. The first change, as can be seen in FIG. 27, is that the hosel is positioned in a forward position, closer to the ball striking face. The second change is the hosel does not include the flared sides of the fifth embodiment.

Figure 29:
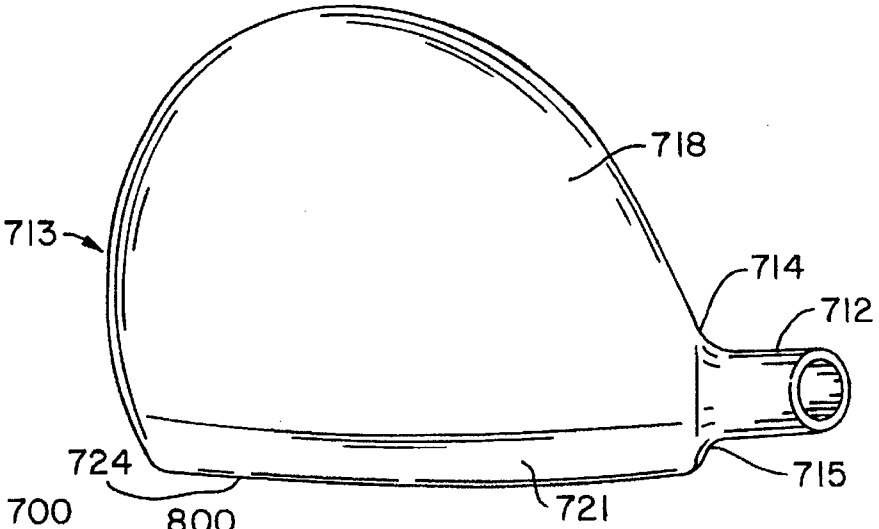
FIG. 29 is a top plan view of the club head of FIG. 28.
Figure 28:
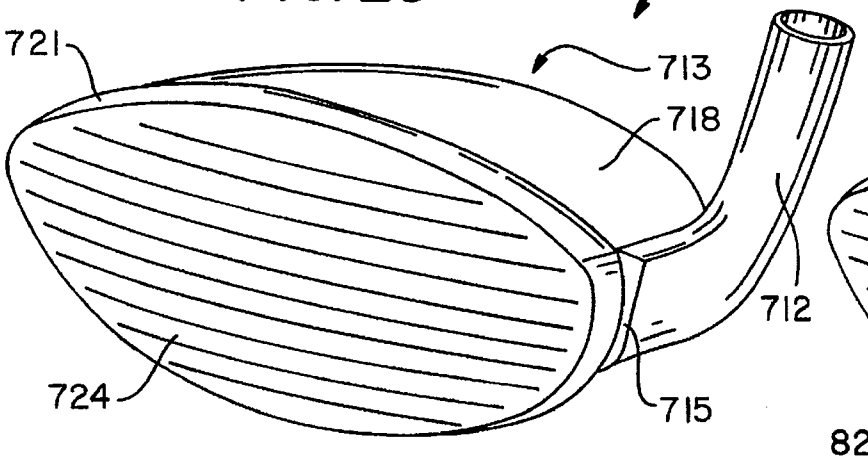
FIG. 28 is a front elevational view of an eighth embodiment of the present invention.

A eighth embodiment of the present invention is illustrated in FIGS. 28 and 29. In this embodiment, the entire cylindrical portion of the hosel 712, its cylindrical walls, and its shaft socket extend outwardly of the hell 714 of the main shell body 713. The hosel 712 is also set back from the ball striking face 724 of the club head. In this embodiment, a buffer zone 715 provides transition between the shell 713 and the hosel 712. This buffer zone 715 preferably has a width, in a toe to heel direction, of at least one-sixteenth of an inch. This embodiment preferably includes the ledge 721 and perimeter weighting system described with reference to the fourth embodiment. In this embodiment, the shaft socket preferably extends downward at least to a point in line with the club head's center of percussion.

Figure 30:
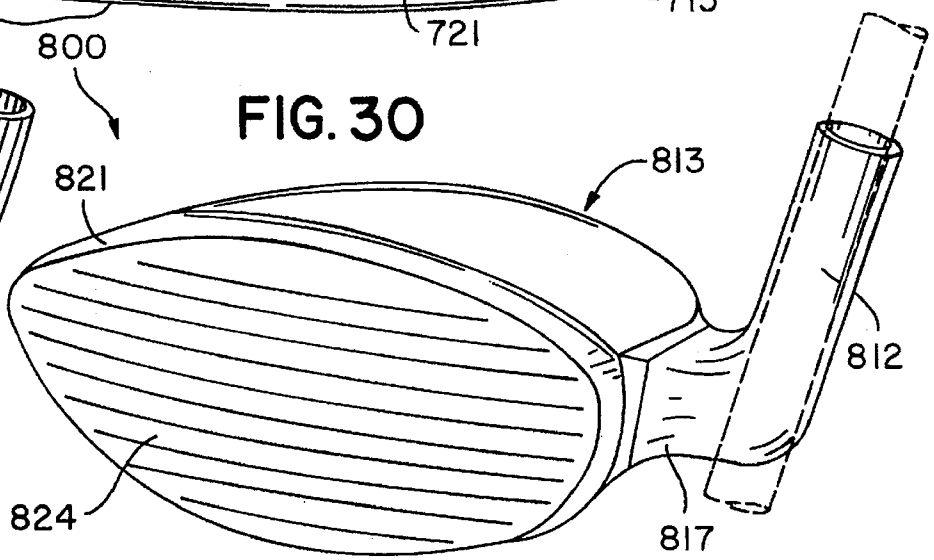
FIG. 30 is a front elevational view of a ninth embodiment of the present invention.

FIG. 30 illustrates a ninth embodiment of the present invention. This embodiment is like those shown in FIGS. 27–29, except that the hosel 812 includes an extension or elbow 817 between the cylindrical portion of the hosel and shell 813 of the club head. The elbow 817 preferably has a width, in a toe to heel direction, of at least one quarter of an inch. For the reasons explained in U.S. patent application Ser. No. 08/124,205, filed Sep. 21, 1993, which is hereby incorporated by reference, this elbow 817 provides increased leverage and control to the club head.

It will be appreciated that the above described embodiments are exemplary only and that the offset hosel structure of the present invention may be formed on any size or shape of wood type club heads. The spirit and scope of the invention will be appreciated by reference to the following claims.

I claim:

1. A metal wood type golf club head comprising:

a main shell body having a toe, heel, upper surface, bottom surface, and ball striking face; and a hosel connected to the main shell body and having at least an outer portion between said upper surface and said bottom surface outside the outer surface of the main shell body of the club head at the heel of the club head.

2. The golf club head of claim 1 wherein at least one-third of the overall diameter of the hosel extends outside the main shell body of the club head in a heel to toe direction.

3. The golf club head of claim 2 wherein the hosel has a shaft-receiving opening and the shaft-receiving opening of the hosel is formed even with the upper surface of the club head.

4. The golf club head of claim 1 wherein at least one-half of the overall diameter of the hosel extends outside the main shell body of the club head in a heel to toe direction.

5. The golf club head of claim 1 wherein at least two-thirds of the overall diameter of the hosel extends outside the main shell body of the club head in a heel to toe direction.

6. The golf club head of claim 1 wherein the hosel has a shaft-receiving opening and the shaft-receiving opening of the hosel is located below the upper surface of the club head.

7. The golf club head of claim 6 wherein the hosel includes a shaft-receiving socket extending along the entire length of the hosel.

8. The golf club head of claim 7 wherein the shaft-receiving socket has an opening at both the top and the bottom of the hosel.

9. The golf club head of claim 8 wherein the shaft-receiving socket is defined by cylindrical walls of the hosel which extend along the entire length of the hosel.

10. The golf club head of claim 1 wherein the hosel connects with the heel of the main shell body along at least one half of the height of the heel.

11. The golf club head of claim 1 wherein the hosel connects with the heel of the main shell body along at least two-thirds of the height of the heel.

12. The golf club head of claim 1 wherein the hosel includes an inner, circumferential wall that forms a socket for a club head shaft, said circumferential wall extending downward beyond the upper surface of the club head and into the shell cavity.

13. The golf club head of claim 12 wherein said circumferential wall extends downward at least one-half of the height of the cavity.

14. The golf club head of claim 13 wherein said circumferential wall extends downward to a point adjacent the bottom surface of the club head.

15. The golf club head of claim 1 wherein a front surface of the hosel serves as a continuation of the club head face.

16. The golf club head of claim 1 wherein the hosel is further defined by a bottom edge which extends downwardly toward said bottom surface at least to a line drawn parallel to said bottom surface and through the center of percussion of the club head.

17. The golf club head of claim 16 wherein said hosel includes a shaft socket extending at least to said bottom edge of said hosel.

18. The golf club head of claim 1 wherein a front surface of the hosel is set back from the ball striking face of the club head, providing a clean break between said face of the main shell body and the hosel.

19. The golf club head of claim 1 wherein a bottom edge of the outer portion of the hosel is spaced above the bottom surface of the club head.

20. The golf club head of claim 1 wherein the ball striking face extends all of the way to a front outer edge of the hosel, in a toe to heel direction.

21. The golf club head of claim 20 wherein the majority of the hosel extends outside, in a toe to heel direction, the outer surface of the main shell body of the club head at the heel.

22. The golf club head of claim 1 wherein the area of the upper surface of the club head is at least twice the area of the bottom surface of the club head, the sides of the main shell body transitioning smoothly from the upper surface to the bottom surface.

23. The golf club head of claim 22 wherein the area of the upper surface of the club head is at least twice the area of the bottom surface of the club head, the sides of the main shell body transitioning smoothly from the upper surface of the bottom surface further comprising a ledge which interfaces at its front edge with the ball striking face and the interfaces at its rear edge with the remaining portion of the upper surface of the club head, the remaining portion transitioning upward to provide a smooth accurate crown.

24. The golf club head of claim 23 wherein the ledge is substantially perpendicular to the ball striking face.

25. The golf club head of claim 24 wherein the ledge has a width, in a front to rear direction, of at least one eighth of an inch.

26. The golf club head of claim 1 further comprising a peripheral weight member that extends around an entire inner rear peripheral edge of the ball striking face.

27. The golf club head of claim 26 wherein the hosel is integrally attached to a portion of said peripheral weight member.

28. The golf club head of claim 1 wherein substantially all of the hosel extends outside the main shell body.

29. The golf club head of claim 28 wherein said hosel includes flared sides that extend beyond the outer diameter of the hosel and provide a smooth connection between the hosel and the main shell body.

30. The golf club head of claim 1 wherein the entire hosel extends outside the main shell body.

31. The golf club head of claim 30 further providing a buffer zone that provides a transition between the main shell body and the hosel.

32. The golf club head of claim 30 further providing an elbow connecting the hosel of the club head with the main shell body, said elbow having a width in a toe to heel direction of at least one-quarter of an inch.

33. A metal wood type golf club head comprising:

a main shell body having a toe, heel, upper surface, bottom surface, and ball striking face, the heel having a curvature generally defined by a first radius; and a hosel connected to the main shell body and having at least an outer portion extending, in a toe to heel direction, outside the outer surface of the main shell body of the club head at the heel of the club head, said outer portion of the hosel having a curvature generally defined by a second radius, the second radius being smaller than the first radius.

34. A metal wood type golf club head comprising:

a main shell body having a toe, heel, upper surface, bottom surface, and ball striking face;

a hosel connected to the main shell body and having at least an outer portion extending, in a toe to heel direction, outside the outer surface of the main shell body of the club head at the heel of the club head;

at least one-third of the overall diameter of the hosel extending outside the main shell body of the club head;

said hosel connecting with the heel of the main shell body along at least one-half of the height of the heel;

said hosel including an inner wall extending downward beyond the upper surface of the club head and into a cavity formed by the main shell body.

* * * * *